US009562543B2

(12) United States Patent
Chang et al.

(10) Patent No.: US 9,562,543 B2
(45) Date of Patent: Feb. 7, 2017

(54) FAN VIBRATION ABSORBING STRUCTURE AND FAN USING SAME

(71) Applicant: Asia Vital Components Co., Ltd., New Taipei (TW)

(72) Inventors: Bor-Haw Chang, New Taipei (TW); Ping-Tsang Ho, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 438 days.

(21) Appl. No.: 14/184,378

(22) Filed: Feb. 19, 2014

(65) Prior Publication Data

US 2015/0233444 A1 Aug. 20, 2015

(51) Int. Cl.

*F04D 19/00* (2006.01)
*F04D 29/66* (2006.01)
*F04D 25/06* (2006.01)

(52) U.S. Cl.

CPC ..... *F04D 29/668* (2013.01); *F04D 25/062* (2013.01)

(58) Field of Classification Search

CPC ..... F04D 29/668; F04D 25/062
See application file for complete search history.

(56) References Cited

U.S. PATENT DOCUMENTS 6,940,195 B2 * 9/2005 Chang ..... H02K 1/187 310/90
2007/0013247 A1 * 1/2007 Tung ..... F04D 29/0513 310/90
2009/0047148 A1 * 2/2009 Chen ..... F04D 29/056 417/354
2011/0229341 A1 * 9/2011 Andrejco ..... F04D 19/002 416/244 R
2012/0171024 A1 * 7/2012 Liu ..... F04D 29/646 415/174.2
2014/0056739 A1 * 2/2014 Wang ..... F04D 25/0606 417/423.7

* cited by examiner

*Primary Examiner* — Nathaniel Wiehe
*Assistant Examiner* — Woody Lee, Jr.

(57) ABSTRACT

A fan vibration absorbing structure includes a bearing cup and a vibration absorbing element. The bearing cup includes a first section, a second section and a bearing holding hole. The first and the second section are connected end-to-end to enclose a receiving space therein, which communicates with the bearing holding hole. The vibration absorbing element is fitted between the first and the second section. With the fan vibration absorbing structure included in a fan, it is able to largely reduce the vibration occurred during fan operation.

7 Claims, 7 Drawing Sheets

FAN VIBRATION ABSORBING STRUCTURE AND FAN USING SAME

FIELD OF THE INVENTION

The present invention relates to a fan vibration absorbing structure, and more particularly, to a fan vibration absorbing structure that largely reduces the vibration occurred during fan operation. The present invention also relates to a fan using the fan vibration absorbing structure.

BACKGROUND OF THE INVENTION

A cooling fan is a heat dissipation unit having good heat dissipation efficiency and being highly flexibly usable with other heat dissipation elements, and is therefore widely used at different places that require heat removal, including but not limited to traffic means, electric appliances, air-conditioning apparatuses and so on.

A cooling fan includes a rotor and a stator. The rotor is driven by electromagnetic induction to rotate relative to the stator. When the rotor rotates, blades thereon rotate at the same time to forcedly guide in and out airflow to dissipate heat. There are several types of fans, including axial-flow fans, cross-flow fans and centrifugal fans. Among others, the axial-flow fans are most frequently used with existing electronic devices for forcedly dissipating the heat produced by individual heat-producing elements and other electronic elements of the electronic devices. The cooling fans will inevitably produce vibration during operation to thereby adversely affect the operation of some precision electronic units, such as the hard disk drive, in the electronic devices. While all types of cooling fans will produce vibration during operation, such vibration is not allowed in some specific working environment, such as in servers. Therefore, it is very important to eliminate the occurrence of vibration during fan operation.

SUMMARY OF THE INVENTION

A primary object of the present invention is to provide a fan vibration absorbing structure, so as to reduce the vibration occurred during fan operation.

Another object of the present invention is to provide a fan with vibration absorbing structure, so as to minimize the vibration occurred during fan operation.

To achieve the above and other objects, the fan vibration absorbing structure according to the present invention includes a bearing cup and a vibration absorbing element. The bearing cup includes a first section, a second section and a bearing holding hole. The first and the second section are connected end-to-end to enclose a receiving space therein, which communicates with the bearing holding hole. The vibration absorbing element is fitted between the first and the second section.

To achieve the above and other objects, the fan with vibration absorbing structure according to the present invention includes a bearing cup, a vibration absorbing element, a bearing, a rotor, a stator, and a fan frame. The bearing cup includes a first section, a second section and a bearing holding hole. The first and the second section are connected end-to-end to enclose a receiving space therein, which communicates with the bearing holding hole. The vibration absorbing element is fitted between the first and the second section. The bearing is held in the bearing holding hole of the bearing cup. The rotor includes a hub, a plurality of blades and a rotary shaft. The rotary shaft is rearwardly projected from a front inner side of the hub and rotatably fitted in the bearing. The stator is externally fitted around the bearing cup. The bearing cup can be associated with the fan frame by insert molding or be integrally formed with the fan frame to forward project therefrom.

By including the fan vibration absorbing structure of the present invention in a fan, the vibration occurred during fan operation can be largely reduced and other components of the fan are also protected against damage possibly caused by such vibration.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
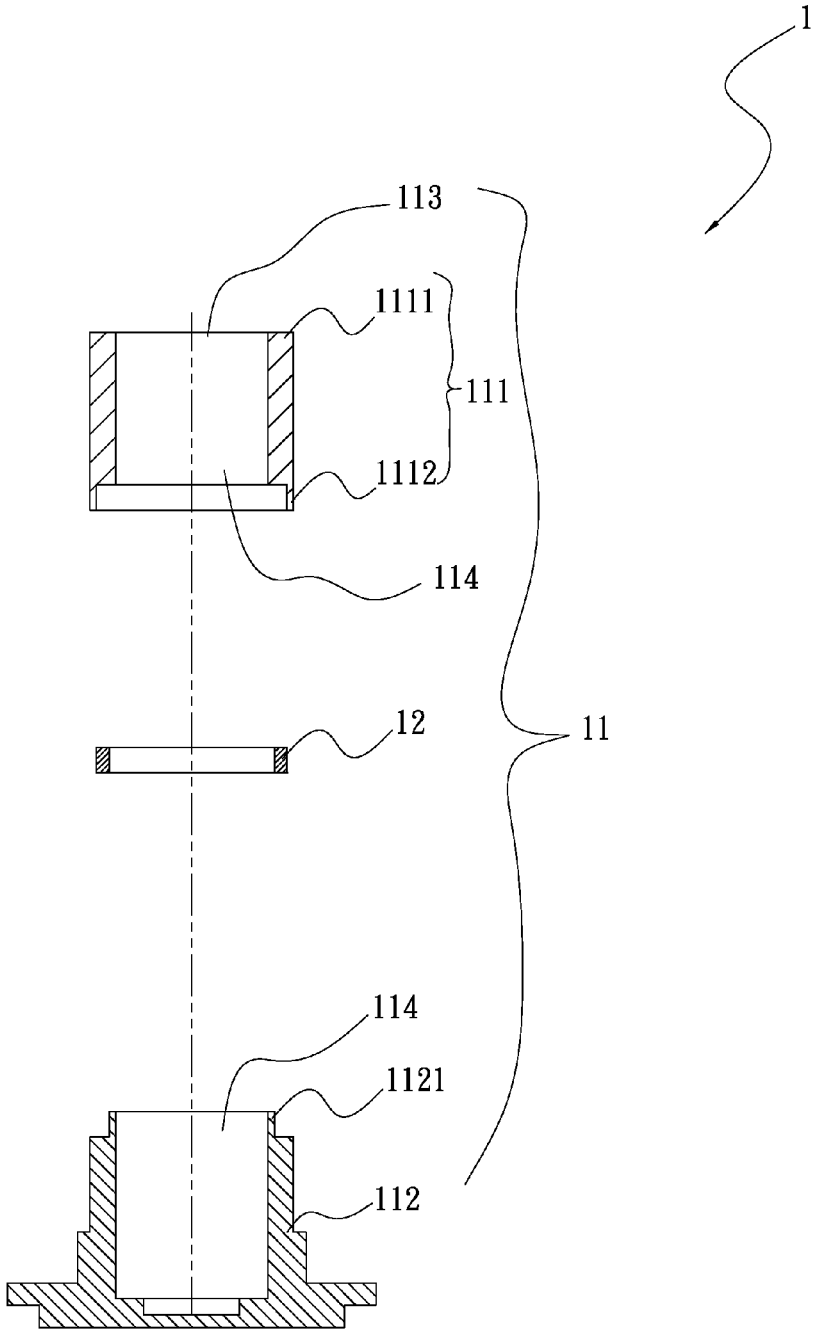
FIG. 1 is an exploded sectional view of a first embodiment of a fan vibration absorbing structure according to the present invention.

The present invention will now be described with some preferred embodiments thereof and with reference to the accompanying drawings. For the purpose of easy to understand, elements that are the same in the preferred embodiments are denoted by the same reference numerals.

Figure 2:
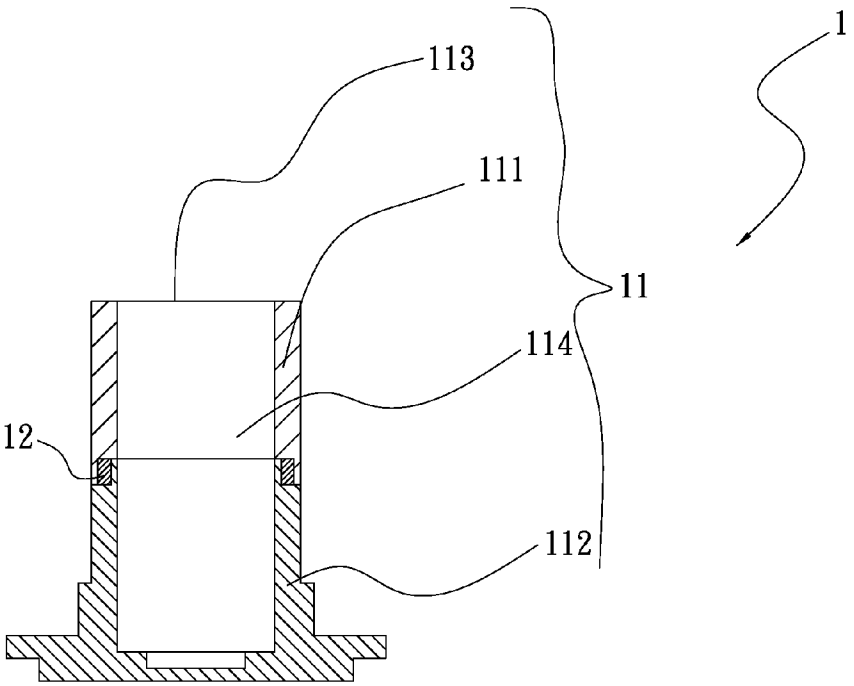
FIG. 2 an assembled view of FIG. 1.

A fan vibration absorbing structure 1 according to the present invention includes a bearing cup 11 and a vibration absorbing element 12, which can be, for example, a vibration absorbing rubber ring. Please refer to FIGS. 1 and 2 that are exploded and assembled sectional views, respectively, of a first embodiment of the fan vibration absorbing structure 1 according to the present invention.

As shown, in the first embodiment, the bearing cup 11 of the fan vibration absorbing structure 1 includes a first section 111, a second section 112, and a bearing holding hole 113. The first and the second section 111, 112 are connected end-to-end to together enclose a receiving space 114 therein, which communicates with the bearing holding hole 113. The vibration absorbing element 12 is fitted between the first section 111 and the second section 112.

The first section 111 has a first open end 1111 and an opposite second open end 1112; and the second section 112 has a third open end 1121. The bearing holding hole 113 axially extends through the first open end 1111 and the second open end 1112 of the first section 111. The vibration absorbing element 12 is fitted between the second open end 1112 and the third open end 1121.

In the first embodiment, the third open end 1121 of the second section 112 has an outer diameter smaller than an inner diameter of the second open end 1112 of the first section 111. Therefore, the first and the second section 111, 112 are connected end-to-end by inserting the third open end 1121 of the second section 112 into the second open end 1112 of the first section 111, and the vibration absorbing element 12 is externally fitted around the third open end 1121 to locate between the second open end 1112 and the third open end 1121.

Figure 3:
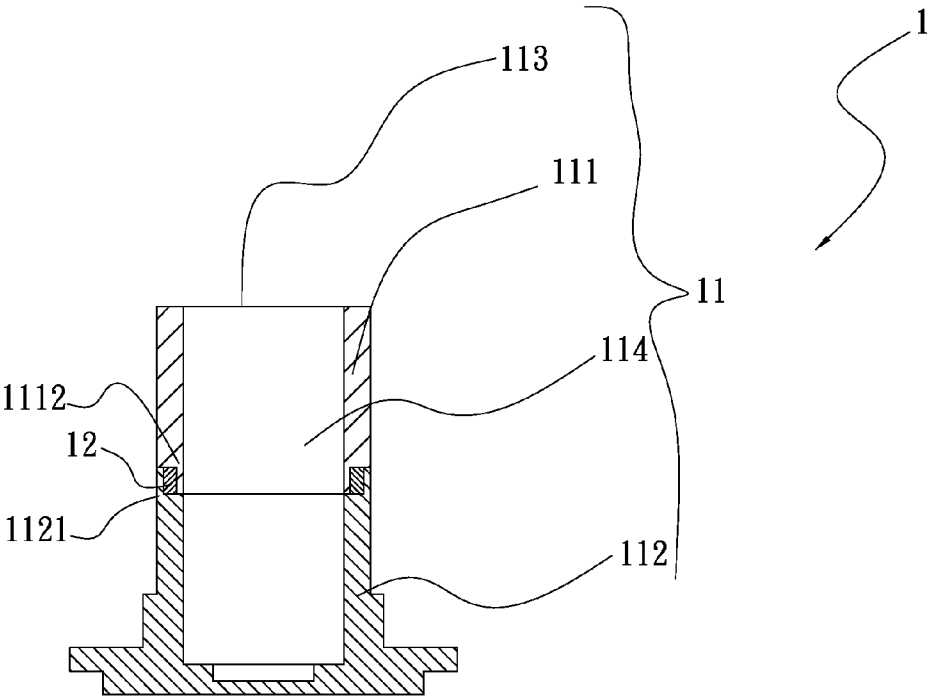
FIG. 3 is an assembled sectional view of a second embodiment of the fan vibration absorbing structure according to the present invention.

FIG. 3 is an assembled sectional view of a second embodiment of the fan vibration absorbing structure 1. The second embodiment is generally structurally similar to the first embodiment, except that the third open end 1121 of the second section 112 has an inner diameter larger than an outer diameter of the second open end 1112 of the first section 111. Therefore, the first and the second section 111, 112 are connected end-to-end by inserting the second open end 1112 of the first section 111 into the third open end 1121 of the second section 112, and the vibration absorbing element 12 is externally fitted around the second open end 1112 to locate between the second open end 1112 and the third open end 1121.

Figure 4:
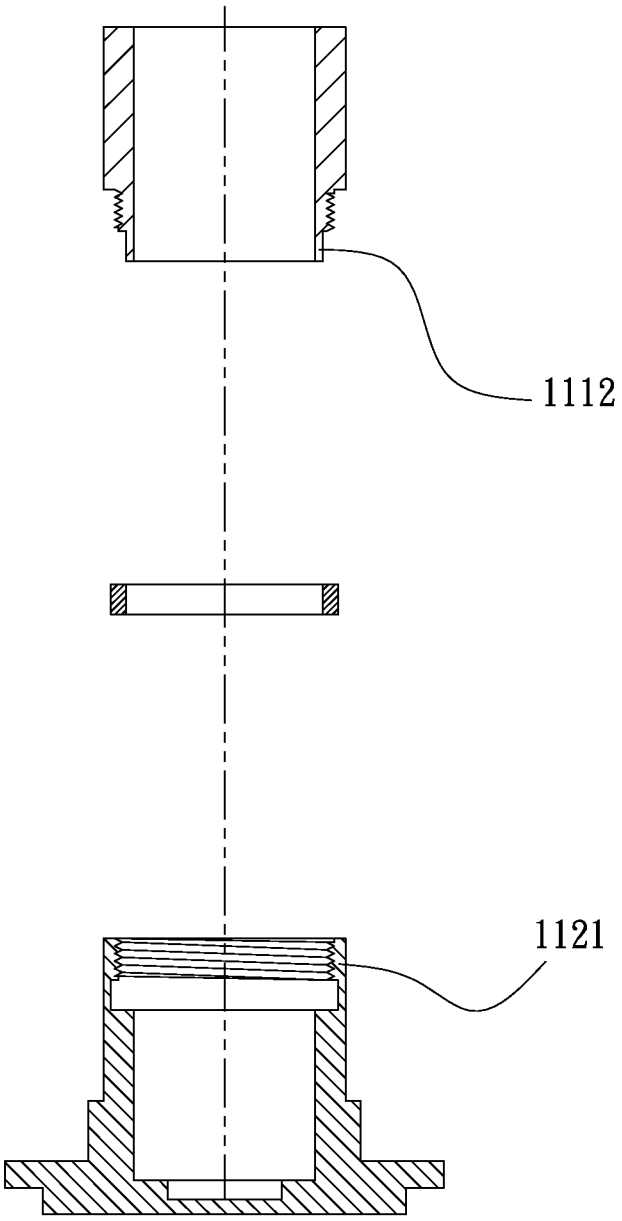
FIG. 4 is an exploded sectional view of a third embodiment of the fan vibration absorbing structure according to the present invention.

FIG. 4 is an exploded sectional view of a third embodiment of the fan vibration absorbing structure 1. The third embodiment is generally structurally similar to the first and the second embodiment, except that the second and the third open end 1112, 1121 are further partially provided with screw threads. In the case the third open end 1121 has an outer diameter smaller than the inner diameter of the second open end 1112, as in the first embodiment, the third open end 1121 is partially externally threaded while the second open end 1112 is correspondingly partially internally threaded. On the other hand, in the case the third open end 1121 has an inner diameter larger than the outer diameter of the second open end 1112, as in the second embodiment, the third open end 1121 is partially internally threaded while the second open end is correspondingly partially externally threaded, as shown in FIG. 4. In either case, the vibration absorbing element is still fitted between the second and the third open end 1112, 1121 that are screwed to each other.

The present invention also provides a fan with vibration absorbing structure. Please refer to FIGS. 5 and 6 that are exploded and assembled sectional views, respectively, of a first embodiment of the fan 2 according to the present invention. As shown, the fan 2 in the first embodiment thereof includes a bearing cup 11, a vibration absorbing element 12, a rotor 21, a stator 22, a fan frame 23, and a bearing 3. Since the bearing cup 11 is structurally identical to that in the fan vibration absorbing structure 1 described above, it is not discussed in detail herein. The bearing 3 is held in the bearing holding space 113 of the bearing cup 11.

The rotor 21 includes a hub 211, a plurality of blades 212 outward extended from an outer surface of the hub 211, and a rotary shaft 213 perpendicularly extended rearward from a front inner side of the hub 211. The rotary shaft 213 is rotatably fitted in the bearing 3, and the bearing 3 can be an oil-impregnated bearing or a ball bearing.

The stator 22 is externally fitted around the bearing cup 11.

The bearing cup 11 for the fan 2 may have a structure corresponding to that described in any of the first, second and third embodiments of the fan vibration absorbing structure 1.

The fan 2 of the present invention is characterized by the bearing cup 11, which is assembled from at least two sections with a vibration absorbing element 12 provided between any two adjacent bearing cup sections. With these arrangements, vibration occurred during the fan operation can be reduced and minimized. Therefore, other elements or components of the fan are also protected against damage possibly caused by the fan vibration.

Figure 5:
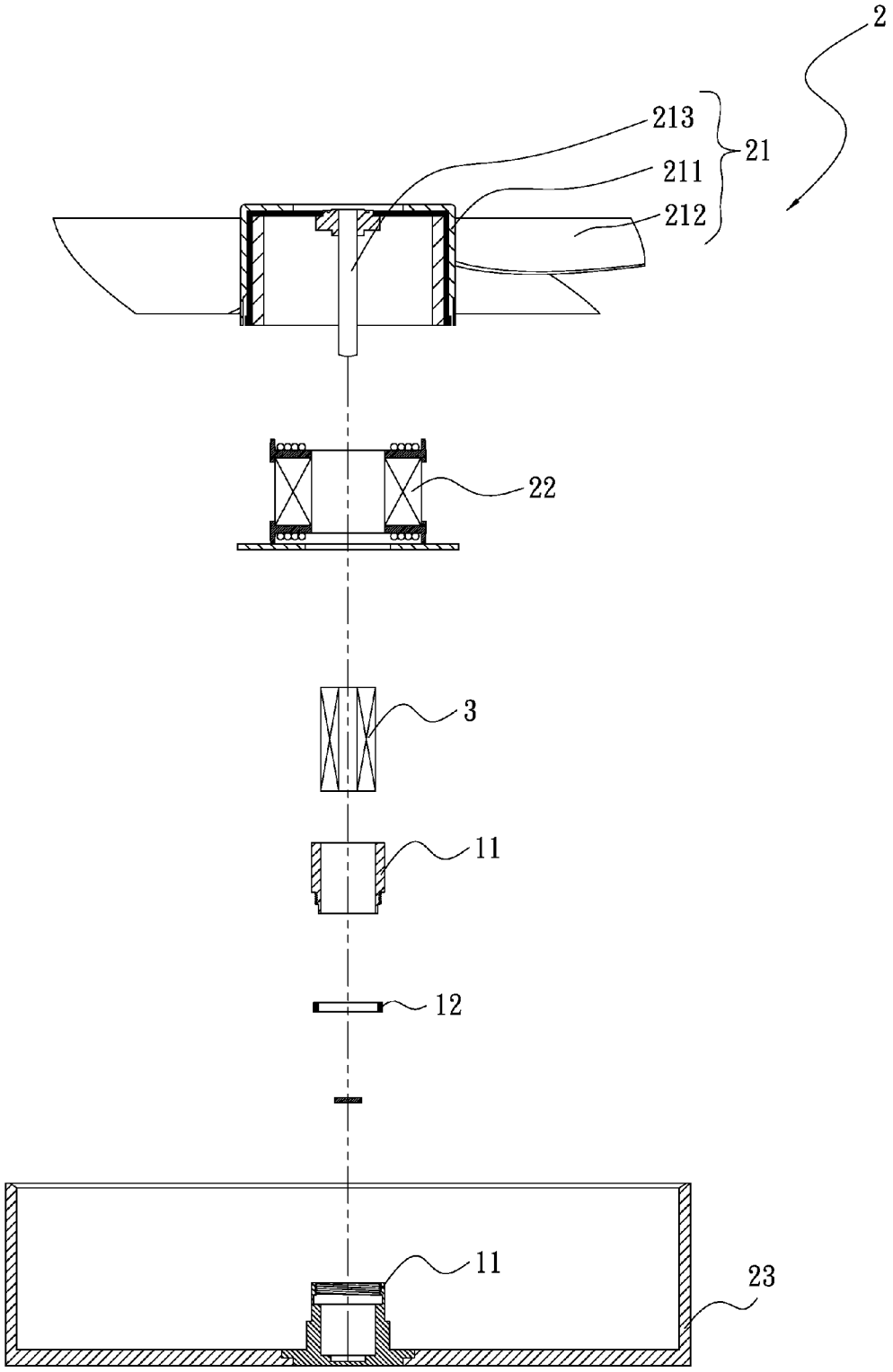
FIG. 5 is an exploded sectional view of a first embodiment of a fan with vibration absorbing structure according to the present invention.
Figure 6:
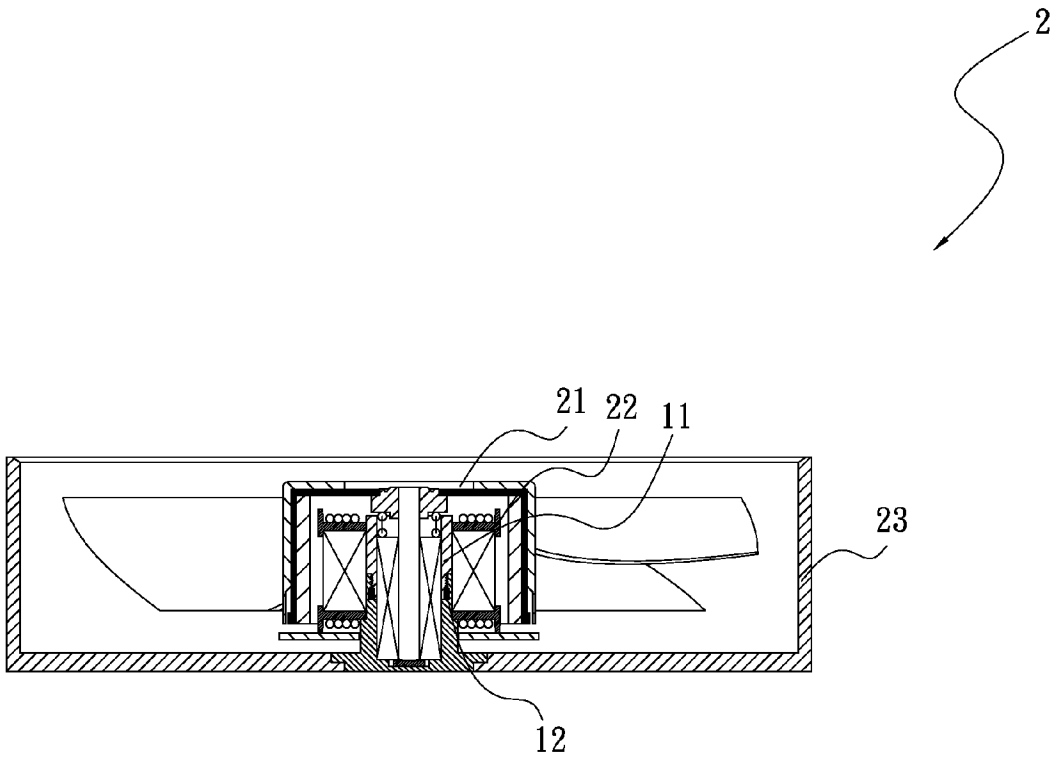
FIG. 6 is an assembled view of FIG. 5.

In the first embodiment of the fan 2, the bearing cup 11 is separately manufactured and then associated with the fan frame 23 by way of insert molding, as shown in FIGS. 5 and 6.

Figure 7:
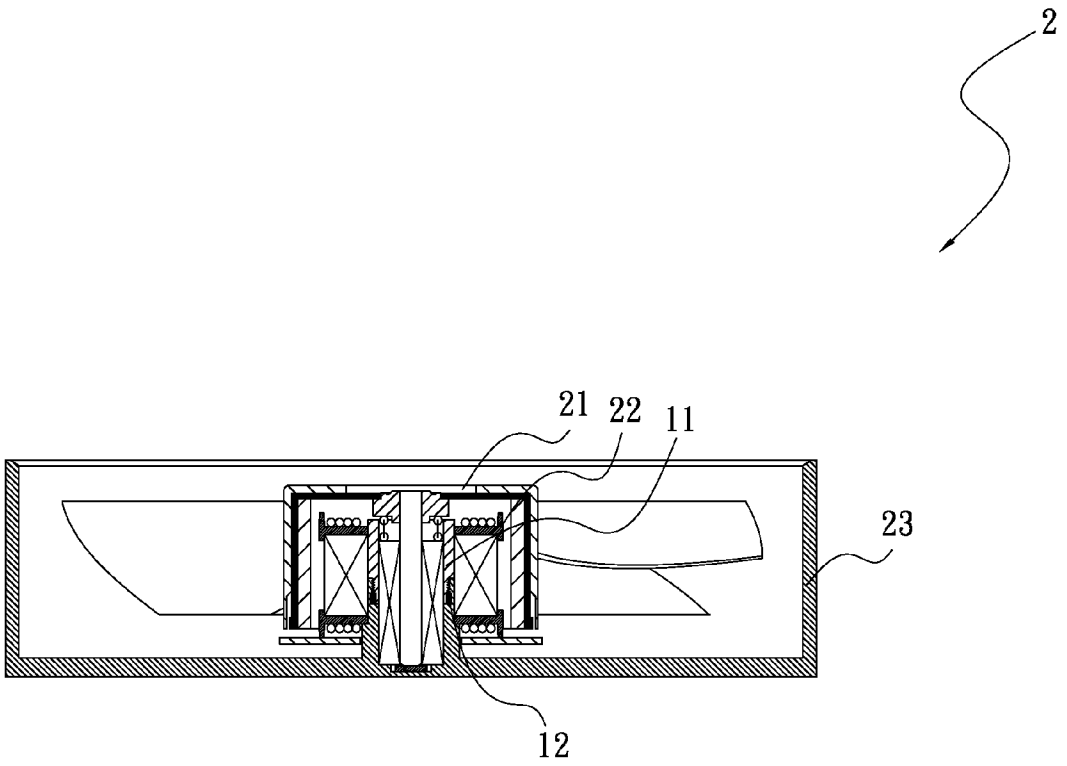
FIG. 7 is an assembled sectional view of a second embodiment of the fan with vibration absorbing structure according to the present invention.

FIG. 7 is an assembled sectional view of a second embodiment of the fan 2. The fan 2 in the second embodiment is generally structurally similar to the first embodiment thereof, except that the bearing cup 11 is integrally formed with the fan frame 23 to project from one inner side of the fan frame 23.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A fan with vibration absorbing structure, comprising:

a bearing cup including a first section, a second section and a hearing holding hole; the first and the second section being connected end-to-end to together enclose a receiving space therein, and the receiving space communicating with the hearing holding hole;

a vibration absorbing element being fitted between the first and the second section;

a bearing being held in the bearing holding hole;

a rotor including a hub, a plurality of blades outward extended from an outer surface of the hub, and a rotary shaft perpendicularly extended rearward from a front inner side of the hub; and the rotary shaft being rotatably fitted in the bearing; and a stator being externally fitted around the bearing cup.

2. The fan with vibration absorbing structure as claimed in claim 1, wherein the first section of the hearing cup has a first open end and an opposite second open end, and the second section of the hearing cup has a third open end; the bearing holding hole axially extending through the first and the second open end of the first section; and the vibration absorbing element being fitted between the second and the third open end.

3. The fan with vibration absorbing structure as claimed in claim 2, wherein the third open end of the second section of the bearing cup has an inner diameter larger than an outer diameter of the second open end of the first section of the bearing cup; and the second open end being inserted into the third open end to connect the first section to the second section.

4. The fan with vibration absorbing structure as claimed in claim 2, wherein the third open end of the second section of the bearing cup has an outer diameter smaller than an inner diameter of the second open end of the first section of the hearing cup; and the second open end being externally fitted around the third open end to connect the first section to the second section.

5. The fan with vibration absorbing structure as claimed in claim 1, wherein the vibration absorbing element is a vibration absorbing rubber ring.

6. The fan with vibration absorbing structure as claimed in claim 1, further comprising a fan frame; and the second section of the bearing cup being associated with the fan frame by way of insert molding.

7. The fan with vibration absorbing structure as claimed in claim 1, further comprising a fan frame; and the second section of the bearing cup being integrally formed with the fan frame to project from one inner side of the fan frame.

* * * * *